United States Patent [19]

Akiyama et al.

[11] 4,335,981

[45] Jun. 22, 1982

[54] CARGO HANDLING EQUIPMENT

[75] Inventors: Seiji Akiyama, Yokohama; Mamoru Kurihara, Koganei; Kazuhiko Ueki, Mitaka, all of Japan

[73] Assignee: Mitsubishi Jukogyo Kabushiki Kaisha, Tokyo, Japan

[21] Appl. No.: 72,597

[22] Filed: Sep. 5, 1979

[30] Foreign Application Priority Data

Sep. 5, 1978 [JP] Japan ..... 53/121912[U]

[51] Int. Cl.[3] ..... E02B 3/20

[52] U.S. Cl. ..... 405/221; 405/219; 114/263; 114/230

[58] Field of Search ..... 405/219, 220, 221; 141/387, 388; 114/267, 266, 265, 263; 414/140-145; 14/31-35, 27, 69.5

[56] References Cited

U.S. PATENT DOCUMENTS

| | | | |
|---|---|---|---|
| 202,415 | 4/1878 | Cumming | 405/196 |
| 2,200,550 | 5/1940 | Helmers | 405/219 |
| 2,759,331 | 8/1956 | Fiebinger et al. | 405/219 |
| 2,948,121 | 8/1960 | Karst | 405/220 |
| 3,005,437 | 10/1961 | Jullien | 405/220 X |
| 3,069,862 | 12/1962 | Ward | 405/219 |
| 3,074,238 | 1/1963 | Golian | 405/219 |
| 3,686,876 | 8/1972 | Muschell | 405/220 |

FOREIGN PATENT DOCUMENTS

| | | | |
|---|---|---|---|
| 220711 | 2/1959 | Australia | 405/219 |

*Primary Examiner*—Dennis L. Taylor

*Attorney, Agent, or Firm*—Wenderoth, Lind & Ponack

[57] ABSTRACT

A cargo handling equipment comprises a stationary column installed offshore of a river or a creek, a stationary bridge bridging the shore of said river or creek and said stationary column and provided with a cargo transportation apparatus, a movable bridge swingably connected to the stationary column and provided with another cargo transportation apparatus, and a floating body detachably secured to the free end of the movable bridge and provided with legs which are vertically movable and can reach the bottom of the river or the creek.

2 Claims, 2 Drawing Figures

CARGO HANDLING EQUIPMENT

Figure 1:
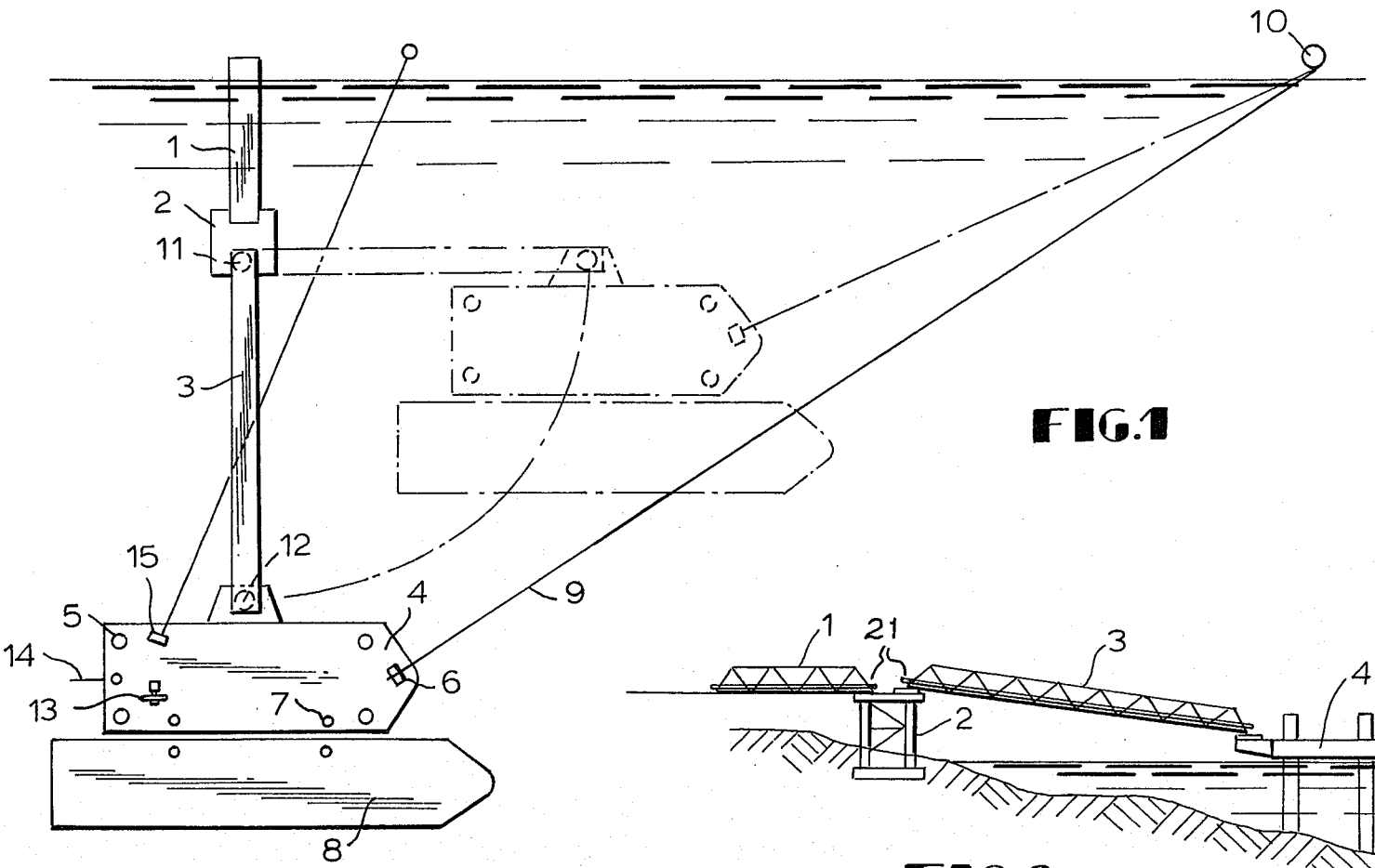

The present invention relates to an improvement in cargo handling equipment used at the shore of a body of water such as a river or a creek where the difference in the water level between the high and the low tides is large.

Heretofore, the cargo handling at such places has been conducted by means of cranes installed on the shore or a pier or cranes on board a vessel. Alternatively, the cargo handling has been conducted by mounting a movable bridge the free end of which is floating on a stationary column which is installed offshore in the body of water, and which is in turn connected to the shore by a stationary bridge, and mooring a barge to the movable bridge, and by making use of the barge, movable bridge and stationary bridge.

In such heretofore known cargo handling equipment, however, there are disadvantages that the height of the barge is changed rather greatly if there is a large change in the water level between the high and the low tides, so that the cargo handling by the cranes cannot be carried out smoothly, and that where barges were used, the mooring and cargo handling becomes quite unstable due to the waves and flow of water.

The invention seeks to overcome the above-stated disadvantages in the prior art. To this end, according to the invention, there is provided a cargo handling equipment comprising a stationary column installed offshore of a body of water, a stationary bridge from the shore of the body of water to the stationary column and provided with a cargo transportation means, a movable bridge swingably connected to the stationary column and provided with another cargo transportation means and a floating body detachably secured to the free end of the movable bridge and provided with legs which are vertically movable and can reach the bottom of the body of water.

The cargo handling equipment of the present invention thus constructed permits a safe and stable cargo handling regardless of a change in the water level, because the floating body is movable vertically in accordance with the change of the water level.

In addition, since the floating body is swingable together with the movable bridge with respect to the stationary column, it is possible to install the cargo handling equipment in such a manner that, after raising the legs to clear the bottom, the floating bodys can be swung in a horizontal plane toward the shore or away from the shore and, then, the legs are lowered to fix the floating body.

Further, since the floating member can be fixed to the bottom or the like by the bottoming of the rigid legs, it can stably be held independently of any change in the flow direction of the water or change of the water level.

As a result, the cargo handling equipment of the present invention permits a constant and stable cargo handling employing the cargo transportation means provided on the stationary and movable bridges, regardless of a change of the water level and the direction of flow of the water.

Figure 2:
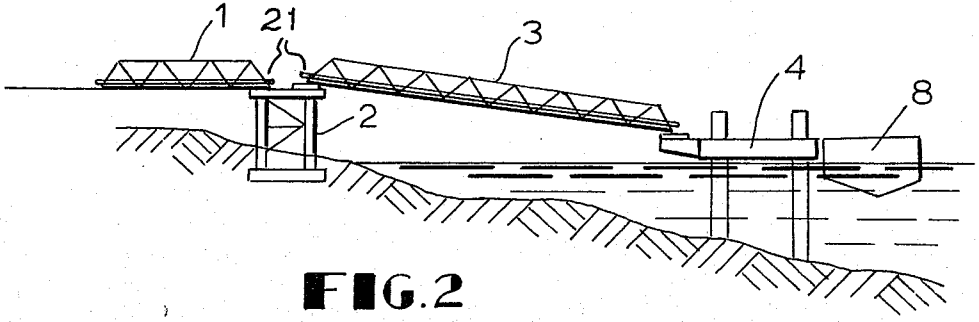

Hereinafter, a preferred embodiment of the invention will be described with reference to the accompanying drawings, wherein:

FIG. 1 is a schematic plan view of one preferred embodiment of the present invention; and FIG. 2 is a left-side elevational view of the embodiment shown in FIG. 1.

Referring to FIGS. 1 and 2, reference numeral 1 denotes a stationary bridge which is extends between the shore and a stationary column 2 which is installed offshore. A movable bridge 3 is secured at its base end to the stationary column 2 for free swinging movement in the horizontal and vertical planes. A pontoon 4 constituting a floating body is detachably secured to the free end of the movable bridge 3.

Legs 5 attached to four corners of the pontoon 4 are vertically movable by means of jacks or the like means. A winch 6 and a capstan or bollard 7 are mounted on the deck of the pontoon 4.

Reference numeral 8 denotes a cargo ship moored to the pontoon 4. Reference numeral 9 denotes a rope or a chain stretched between the winch 6 and a bollard 10 on shore. As the winch 6 is operated, the movable bridge 3 and the pontoon 4, together with the cargo shop 8 moored to the latter can be swung in the upstream or downstream direction around the stationary column 2. Reference numerals 11, 13 and 14 denote, respectively, a turn table, ballast pump and a rudder, which in combination assists the movement of the ship 8 and so forth when the latter are moved in the manner described above. The swinging of the ship 8 can be achieved also by means of a screw propeller and the above-mentioned rubber, instead of using the winch 6. Reference numeral 15 denotes a winch for controlling the position of pontoon 4.

The stationary and the movable bridges 1 and 3 may be provided with conveyors 21 by means of which the cargoes are handled and conveyed, if wrapped cargoes or containers are handled. In the case where the cargo is a powdered material or fluids, the bridges can have pipe lines for fluidly transporting such a cargo. In such a case, the pipe lines are connected by means of flexible joints provided at the stationary column 2.

In the illustrated embodiment constructed as described above, when the location of cargo handling is shifted from the position shown by full-lines to the upstream position shown by chain lines, at first the legs 5 are retracted to causes the pontoon to float freely in the water and the rope 9 is wound up by the winch 6 until the pontoon 4 is moved to the position suitable for the cargo handling, taking the water level and the ship position into account. The posture of the pontoon 4 is controlled by adjustment of the rudder 14 attached to the pontoon 4.

After setting the pontoon 4 at the desired position in the manner as described above, the ballast pump 13 is started to fill a ballast tank in the pontoon 4. Then, the legs 5 are extended to cause them to contact the bottom of the body of water and to raise and fix the pontoon 4 at a suitable level above the water level.

Subsequently, the ship 8 is moored to the pontoon 4 by means of the capstan and the bollard. Then, loading and unloading of the cargo is conducted by means of cargo handling machines (not shown) on the pontoon 4. The cargo is then handled and transported by the cargo transportation means (not shown) installed on the movable bridge 3 and the stationary bridge 1.

After the handling of the cargo, the ballast water is discharged and the legs 5 are retracted to permit the pontoon 4 to float. For shifting the pontoon 4 downstream (off-shore side), the above-described operation is reversed and the pontoon 4 is set at the desired position making use of the flow of the water.

As will be seen from the foregoing description, the cargo handling equipment of the invention has a simple construction and the shifting and setting of the pontoon can be carried out quite easily, coping with a large change in the water level and change of direction of the flow of water or tides. Thus, the cargo handling equipment of the invention permits a safe and sure mooring of the cargo ship and the cargo handling, contributing to the improvement in the efficiency of the cargo handling work.

What is claimed is:

1. Cargo handling equipment comprising: a stationary column offshore of the bank of a body of water, a stationary bridge extending from the shore to said stationary column and having a cargo transportion means thereon, a movable bridge having one end connected to said stationary column for swinging movement in the horizontal and vertical directions and having a further cargo transportation means thereon and a floating body detachably secured to the other end of said movable bridge and having legs which are vertically movable and can reach the bottom of the body of water.

2. Cargo handling equipment as claimed in claim 1 in which the attachment of said floating body to said movable bridge is also a pivotal attachment for permitting pivoting of said floating body around said other end of said movable bridge in a horizontal plane, and means on said floating body for adjusting the attitude of said floating body relative to the shore for positioning said floating body to accommodate flow of the water in the body of water.

* * * * *